US007182198B2

(12) United States Patent
Chien et al.

(10) Patent No.: US 7,182,198 B2
(45) Date of Patent: Feb. 27, 2007

(54) POWER CONTROL CIRCUIT FOR USE IN A VENDING MACHINE

(75) Inventors: Tien-Yuan Chien, Taipei (TW); Jyh-Chyang Hsieh, Pate (TW); Yeuh-Ping Hsu, Sanchung (TW)

(73) Assignee: International Currency Technologies Corporation (TW)

( * ) Notice: Subject to any disclaimer, the term of this patent is extended or adjusted under 35 U.S.C. 154(b) by 0 days.

(21) Appl. No.: 11/202,939

(22) Filed: Aug. 11, 2005

(65) Prior Publication Data

US 2006/0011448 A1 Jan. 19, 2006

Related U.S. Application Data

(63) Continuation-in-part of application No. 10/436,130, filed on May 13, 2003, now Pat. No. 6,991,129.

(51) Int. Cl.
*G07D 7/00* (2006.01)

(52) U.S. Cl. ..... 194/207

(58) Field of Classification Search ..... 194/207, 194/205, 206, 302; 221/9, 15
See application file for complete search history.

(56) References Cited

U.S. PATENT DOCUMENTS 4,848,556 A * 7/1989 Shah et al. ..... 194/212
5,316,124 A * 5/1994 Barnes et al. ..... 194/206
2004/0178209 A1 9/2004 Chien et al.

* cited by examiner

*Primary Examiner*—Patrick Mackey
*Assistant Examiner*—Mark J Beauchaine
(74) *Attorney, Agent, or Firm*—Andrew D. Fortney

(57) ABSTRACT

A power control circuit used in a vending machine having a bill accepter and vending main units controlled by the bill accepter is disclosed to include a pulse signal generator installed in the bill inlet of the bill accepter and adapted to generate a triggering signal upon insertion of a bill into the bill inlet of the bill accepter, a driver, and a trigger, which controls the driver to drive the bill accepter between the power-saving stand-by mode and the work mode subject to the presence of the pulse signal from the pulse signal generator.

14 Claims, 8 Drawing Sheets

POWER CONTROL CIRCUIT FOR USE IN A VENDING MACHINE

This is a continuation-in-part of application Ser. No. 10/436,130, filed May 13, 2003, now U.S. Pat. No. 6,991, 129, issued on Jan. 31, 2006.

BACKGROUND OF THE INVENTION

1. Field of the Invention

The present invention relates to a power control circuit for use in a vending machine and, more particularly, to such a power control circuit, which drives the bill accepter of the vending machine into the power-saving stand-by mode when the bill accepter receiving no bill.

2. Description of the Related Art

In public places, a variety of automatic vending machines may be installed to provide candy, ticket, changes, etc., when a coin or bill is dropped in. A big vending machine comprises a bill accepter and a number of vending main units. Conventional vending machines are commonly designed to consume city power supply directly. When installed, the bill accepter is constantly maintained turned on. Because the bill accepter is constantly maintained turned on, much electricity is consumed when the vending machine runs idle.

Therefore, it is desirable to provide a power control circuit for use in a vending machine, which eliminates the aforesaid drawbacks.

SUMMARY OF THE INVENTION

The present invention has been accomplished under the circumstances in view. It is therefore the main object of the present invention to provide a power control circuit for use in a vending machine, which automatically turns the bill accepter from the working mode to the stand-by mode when vending machine receiving no bill, or from the stand-by mode to the working mode when the vending machine receiving a bill. According to one embodiment of the present invention, the power control circuit comprises a pulse signal generator installed in the bill inlet of the bill accepter of the vending machine and adapted to generate a triggering signal upon insertion of a bill into the bill inlet of the bill accepter, a driver, and a trigger, which controls the driver to drive the bill accepter between the power-saving stand-by mode and the work mode subject to the presence of the pulse signal from the pulse signal generator. According to an alternate form of the present invention, the power control circuit comprises a trigger adapted to generate a triggering signal, and a driver adapted to receive the triggering signal from the trigger. The driver connects power supply to the bill accepter when receiving the triggering signal from the trigger, or disconnects power supply from the bill accepter when receiving no signal from the trigger.

DETAILED DESCRIPTION OF THE PREFERRED EMBODIMENT

Figure 1:
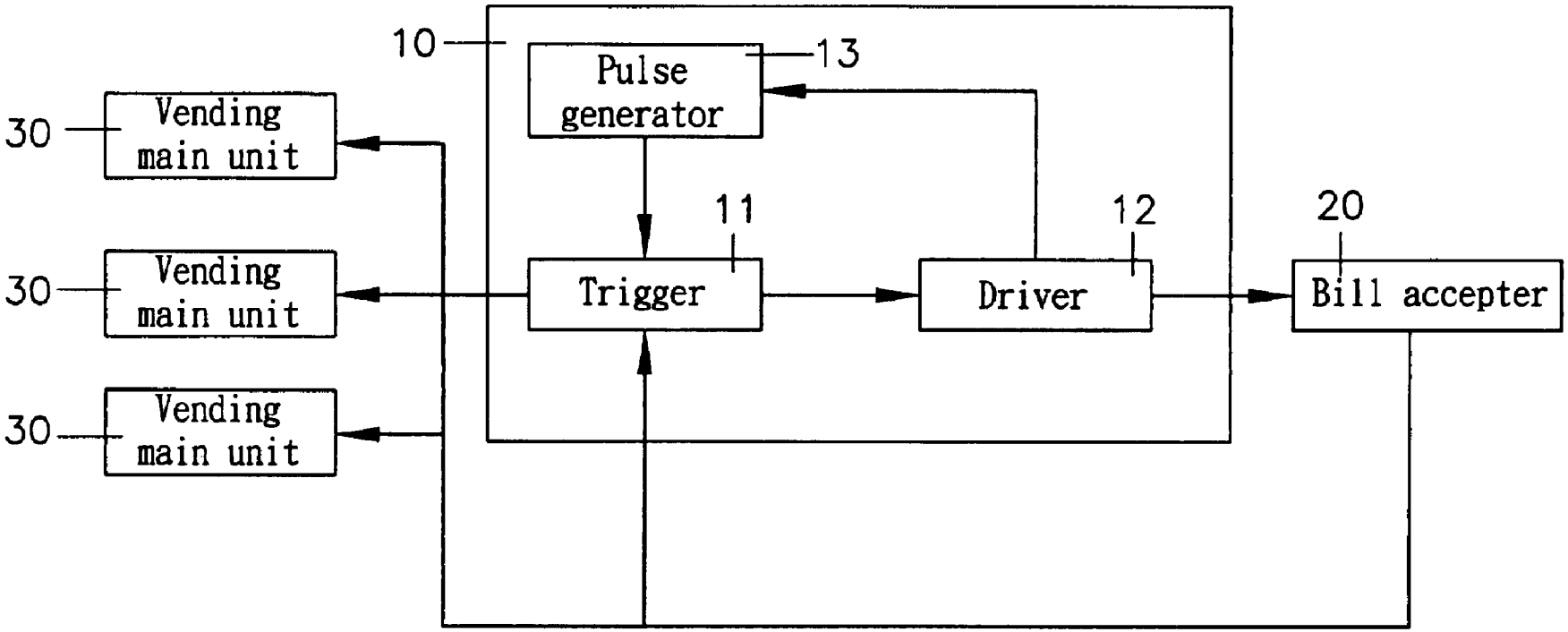
FIG. 1 is a circuit block diagram showing the system arrangement under the first trigger mode according to the present invention.
Figure 3:
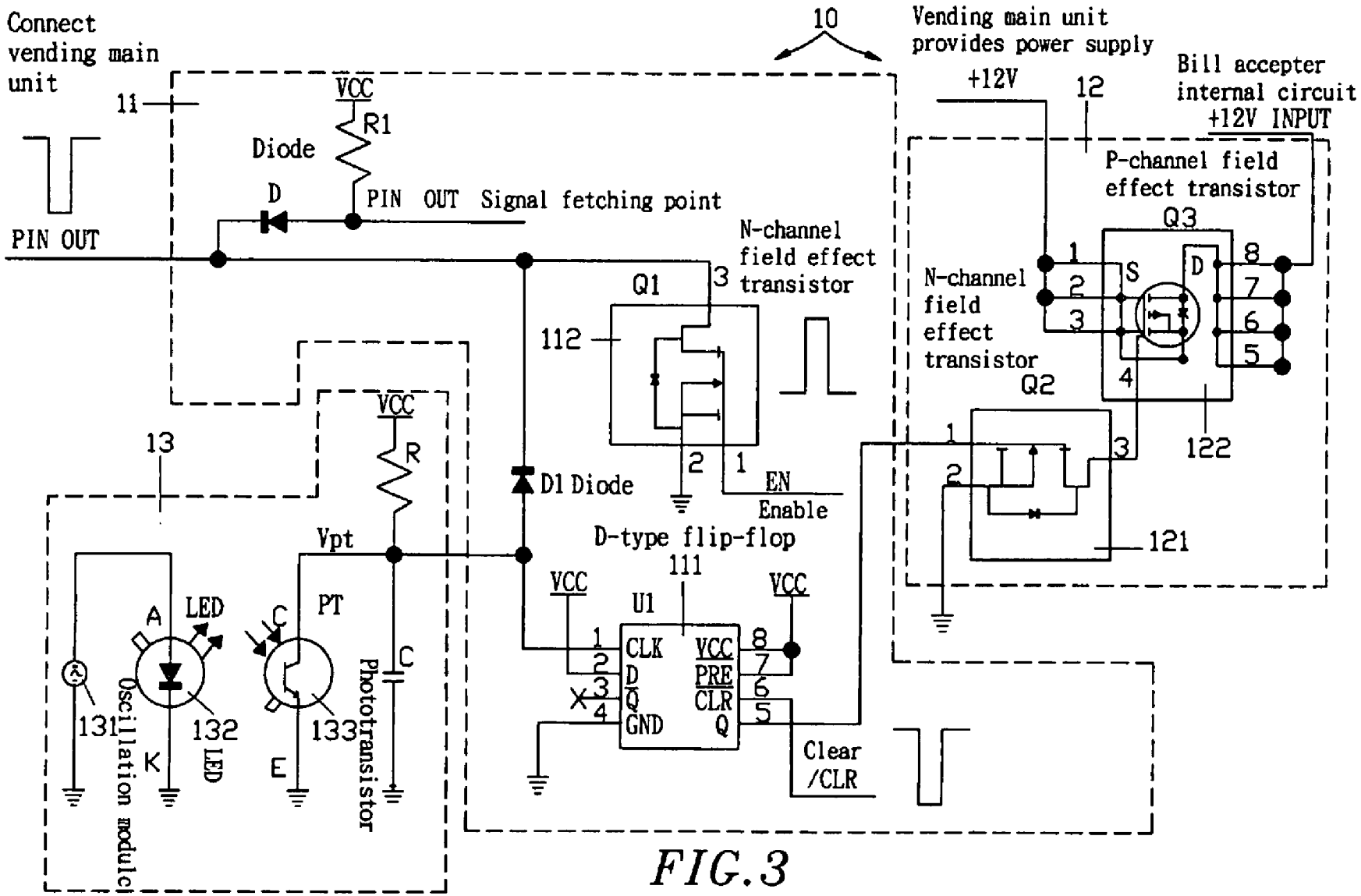
FIG. 3 is a circuit block diagram of the power control circuit according to the present invention.

Referring to FIGS. 1 and 3, a power control circuit 10 constructed according to the first trigger mode of the present invention is installed in a vending machine and electrically connected between the bill accepter 20 and vending main units 30 of the vending machine, comprising a pulse signal generator 13, a trigger 11, and a driver 12. The pulse signal generator 13 is installed in the inlet of the bill accepter 20. The PIN OUT of the trigger 11 is connected to the vending main units 30.

After a predetermined length of time in which the inlet of 5 the bill accepter 20 received no bill, the bill accepter 20 triggers a D-type flip-flop (U1) 111 to draw PIN6 from high potential to low potential, thereby causing PINS to be zeroed. At this time, a N-channel field effect transistor (42) 121 of the driver 12 is caused to turn off a P-channel field effect transistor (Q3) 122, stopping 10 main power supply from passing to the bill accepter 20, and therefore the bill accepter 20 directly enters the power-saving stand-by mode and outputs an enable signal EN to a N-channel field effect transistor (Q1) 112 of the trigger 11 to keep PIN OUT in high potential, informing the vending main units 30 of the stand-by mode status of the bill accepter 20. When entered the stand-by mode, an oscillation module 131 of the pulse signal generator 13 drives a LED (light emitting diode) 132 to emit light, which is ten received by a phototransistor 133 to hold Vpt in low potential, waiting for work mode.

When a bill entered the inlet of the bill accepter 20, it blocks the light of the LED 132, thereby causing RC (resistance-capacitance) to be charged to change Vpt from low potential to high potential and to further trigger PIN1 of the D-type flip-flop (U1) 111 and change the status of PIN5 of the D-type flip-flop (U1) 111 from low potential to high potential. When PIN5 of the D-type flip-flop (U1) 111 changed to high potential, the N-channel field effect transistor (Q2) 121 is driven to turn on the 5 P-channel field effect transistor (Q3) 122, enabling main power supply to pass to the bill accepter 20. At this time, the trigger 11 outputs an enable signal to drive the N-channel field effect transistor (Q1) 112, causing PIN OUT to be changed from high potential to low potential. When PIN OUT changed to low potential, the trigger 11 gives a signal to the vending main units 30, informing the vending main units 30 of the work mode status of the bill accepter 20.

To save more electrical energy, at the beginning of operation the bill acceptor 20 could be on the stand-by mode and the main vending unit 30 could be on a power-saving mode. In the power-saving mode or the stand-by mode, the consuming electrical current thereof is almost zero or could be equal to zero. When the bill is inserted, according to the aforesaid the trigger 11 generates the triggering signal to the driver 12 and then the driver 12 will drive the bill accepter 20 from the stand-by mode to a work mode. During the work mode, the bill accepter 20 will discriminate the true or false of the inserted bill. After the bill is authenticated by the bill accepter 20, the bill accepter 20 then drives the vending main unit 30 from the power-saving mode to a normal service mode to provide the dispensing product like drink, or other operation service such as the game playing. On the other hand, if the bill is fake after discrimination, the bill accepter 20 rejects the false bill and will not activate the vending main unit 30, and then it will stay in the power-saving mode, therefore, in such situation the vending main unit 30 will consumes almost zero electrical current.

Figure 1A:
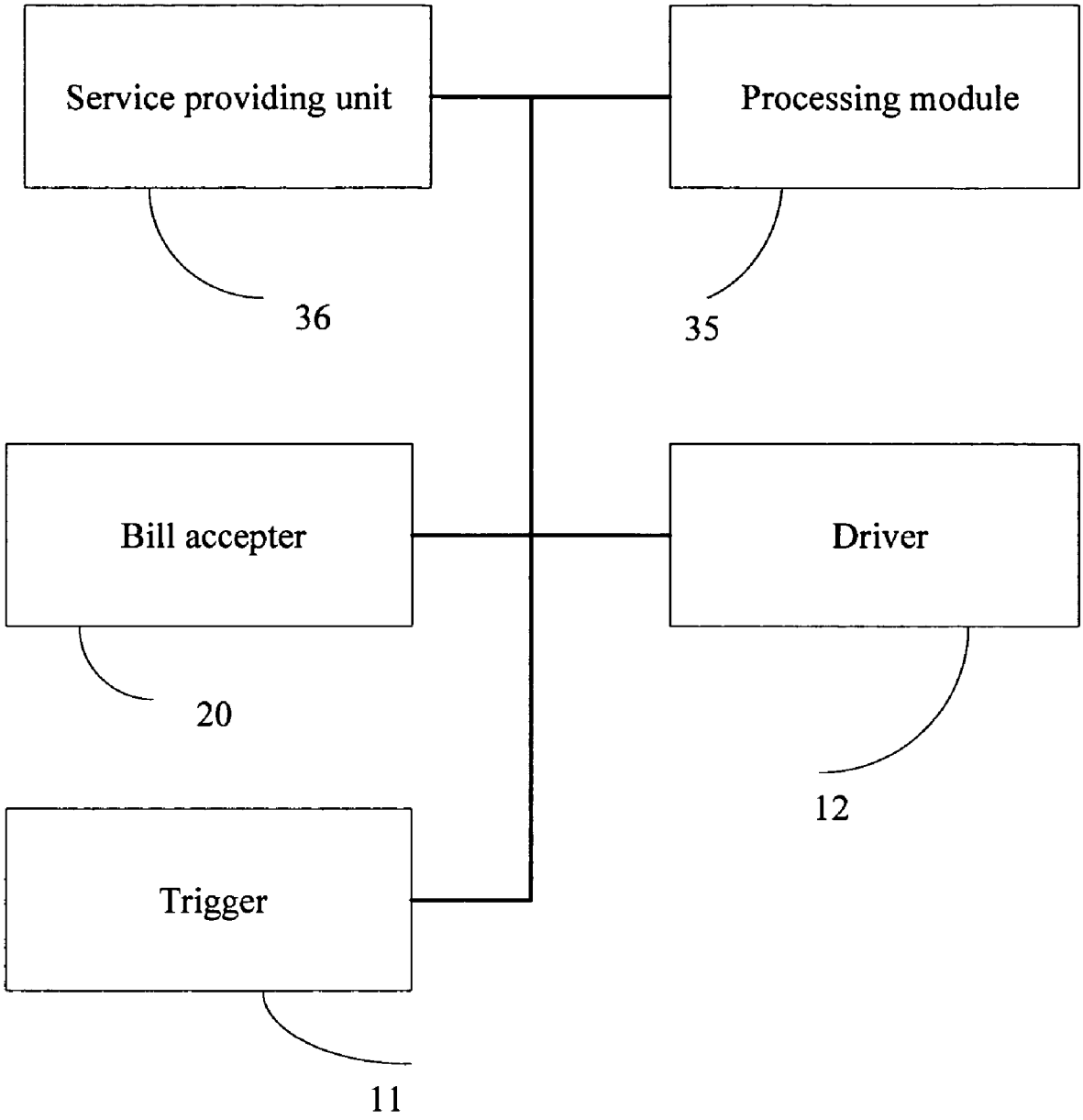
FIG. 1*a* is a circuit block diagram showing another embodiment according to the present invention.

Please refer to FIG. 1*a*, this invention could also additionally provide a processing module 35 to control the operation period of the vending main unit, especially when the vending main unit provides game playing services to the public. In such case the vending main unit 30 could be called as a service providing unit 36. The processing module 35 comprises a memory 351 storing a predetermined condition for the operation period of the service providing unit 36. For example, the predetermined condition provides different fee schedules of the service providing unit 36 at different time, such as one dollar per game or per minute from 9:00 am~5:00 pm and two dollar per game or per minute from 5:00 pm~1:00 am, etc. Based on the value of the authenticated bill and the predetermined condition, the processing module 35 activates the service providing unit 36 during a first period of time, thereafter the service providing unit 36 stops to provide the service and waits for further instruction.

Figure 2:
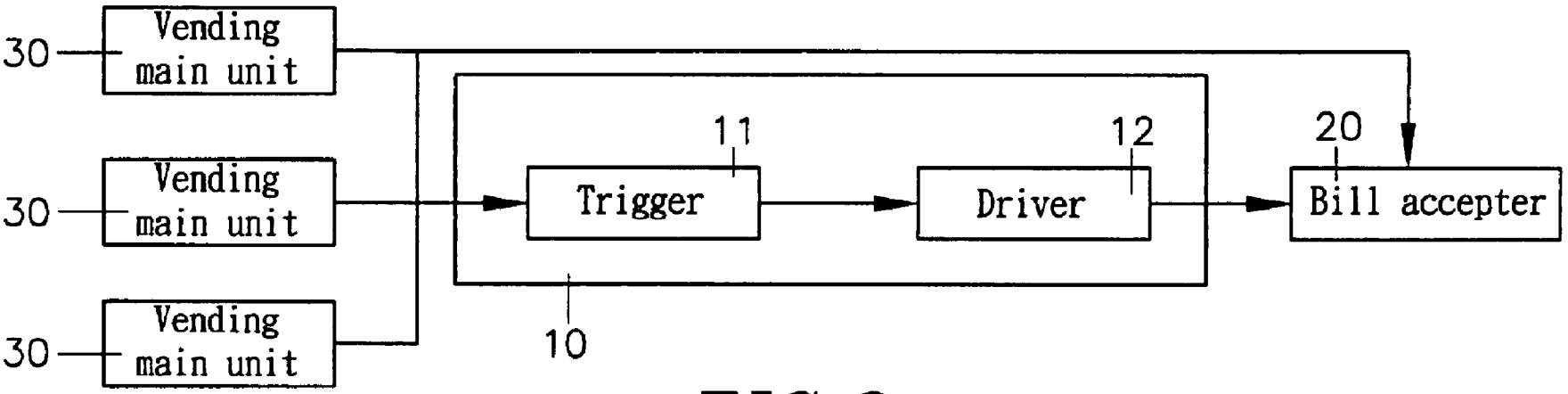
FIG. 2 is a circuit block diagram showing the system arrangement under the second trigger mode according to the present invention.

FIG. 2 is a circuit block diagram of the second trigger mode according to the present invention. The power control circuit 10 is electrically connected between a bill accepter 20 and a plurality of vending main units 30, comprising a trigger 11, and a driver 12.

Referring to FIGS. 2 and 3 again, when the vending main units 30 not triggered (for example, the respective press-buttons are off), the bill accepter 20 is changed from the work mode to the stand-by mode. The flow of changing from the work mode to the stand-by mode is outlined hereinafter. The diode D detects the potential level of PIN OUT. When high potential of PIN OUT detected, PIN6 of the D-type flip-flop (U1) 111 of the trigger 11 is triggered by means of a low potential, causing PIN5 of the D-type flip-flop (U1) 111 of the trigger 11 to be changed from high potential to low potential. The low potential signal is then passed from PIN5 of the D-type flip-flop (U1) 111 of the trigger 11 through the N-channel field effect transistor (Q2) 121 to the P-channel field effect transistor (43) 122, thereby causing the P-channel field effect transistor (43) 122 to stop main power supply from passing to the bill accepter 20, and therefore the bill accepter 20 enters the power-saving stand-by mode.

When one vending main unit 30 is triggered (switched on, for example an activating device in the vending main unit 30 is active by mechanical force, magnet force, or other physical force), a pulse is sent through PIN OUT to trigger PIN1 of the D-type flip-flop (U1) 111 of the trigger 11, thereby causing PIN5 of the D-type flip-flop (U1) 111 of the trigger 11 to be changed from low potential to high potential, which high potential is ten sent through 15 the N-channel field effect transistor (42) 121 of the driver 12 to the P-channel field effect transistor (Q3) 122, thereby causing the P-channel field effect transistor (Q3) 122 to be turned on to let main power supply pass to the bill accepter 20, and therefore the bill accepter 20 enters the work mode.

Figure 4:
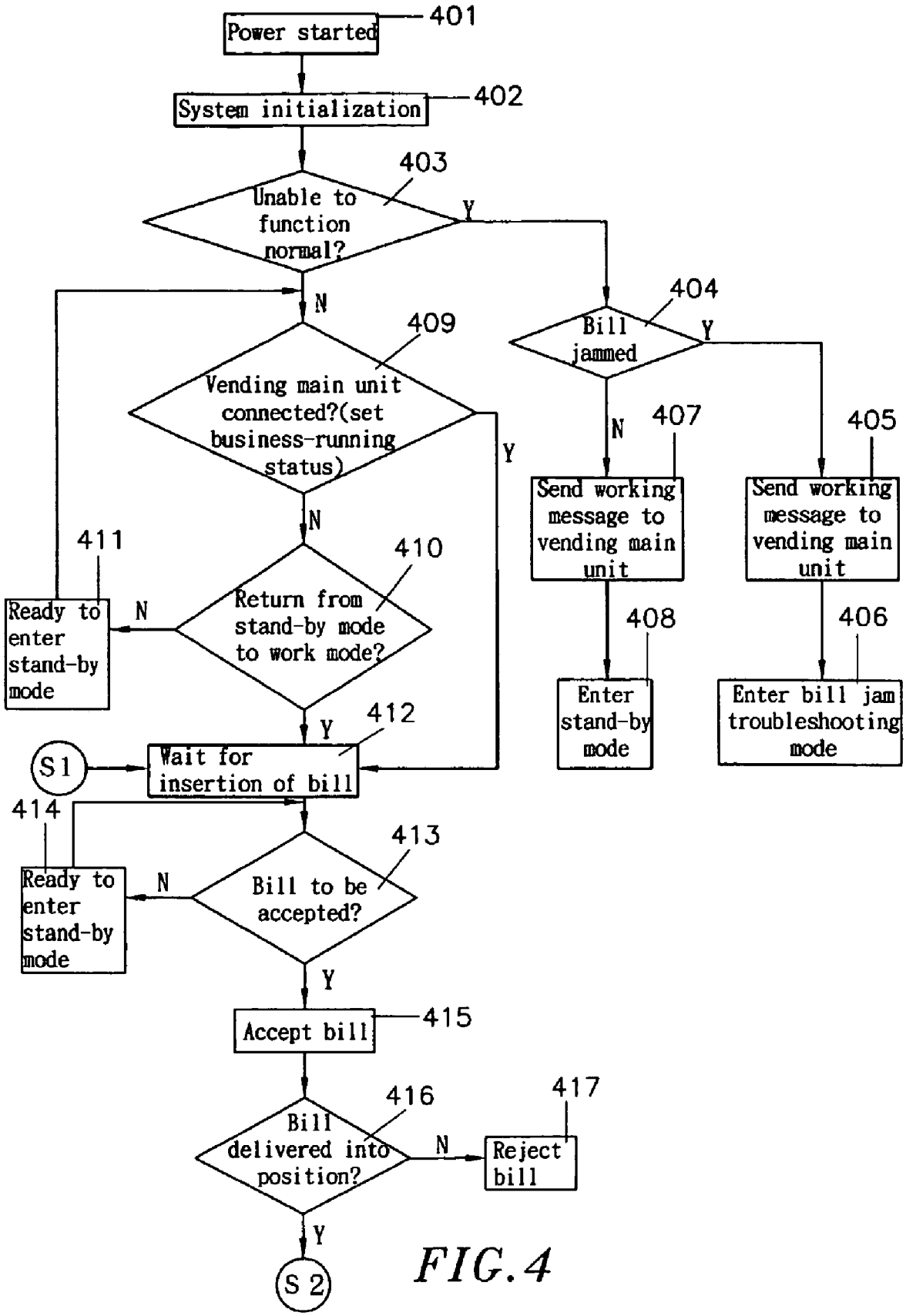
FIG. 4 is an operation flow of the present invention when started (I).
Figure 4A:
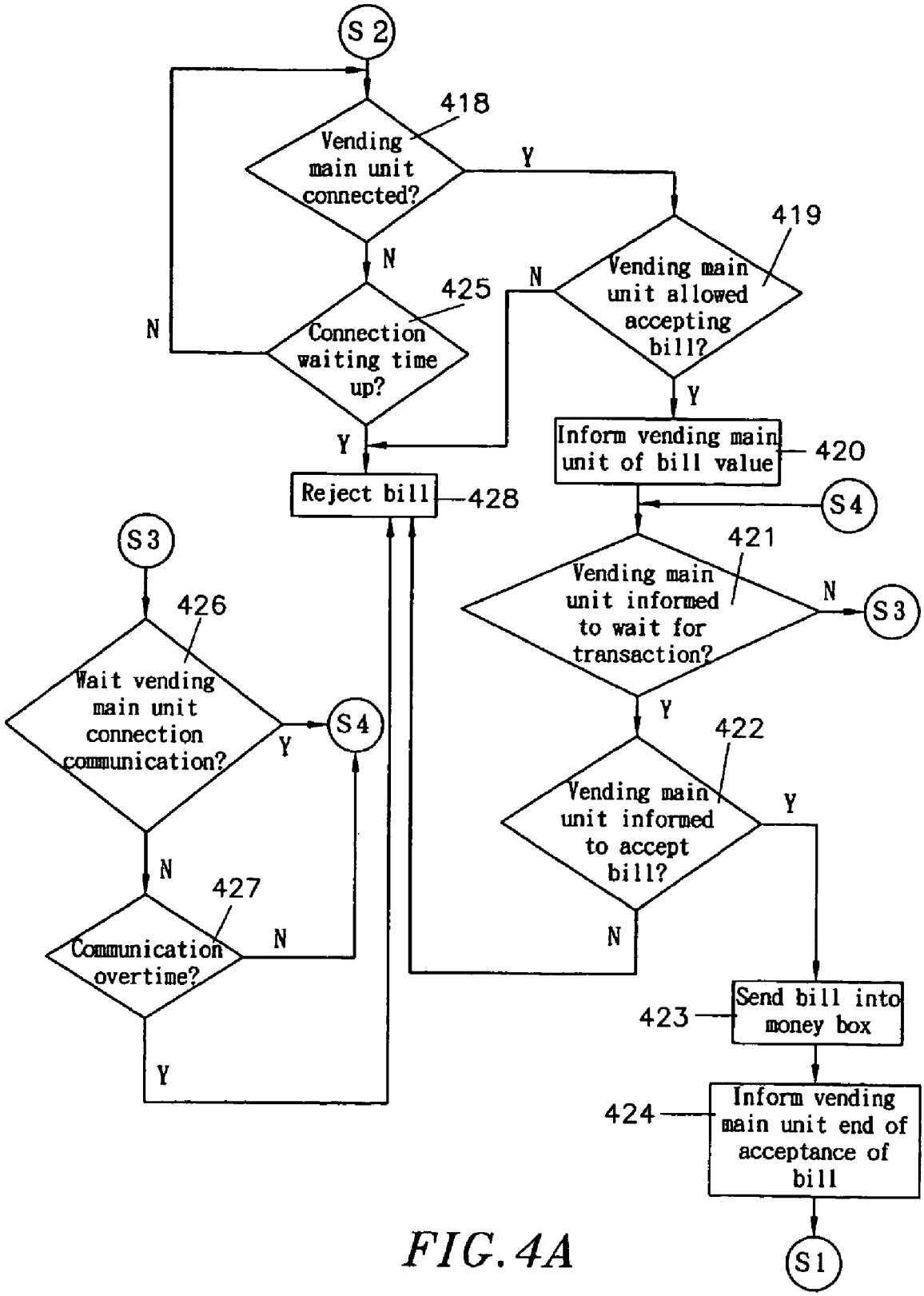
FIG. 4A is an operation flow of the present invention when started (11).
Figure 5:
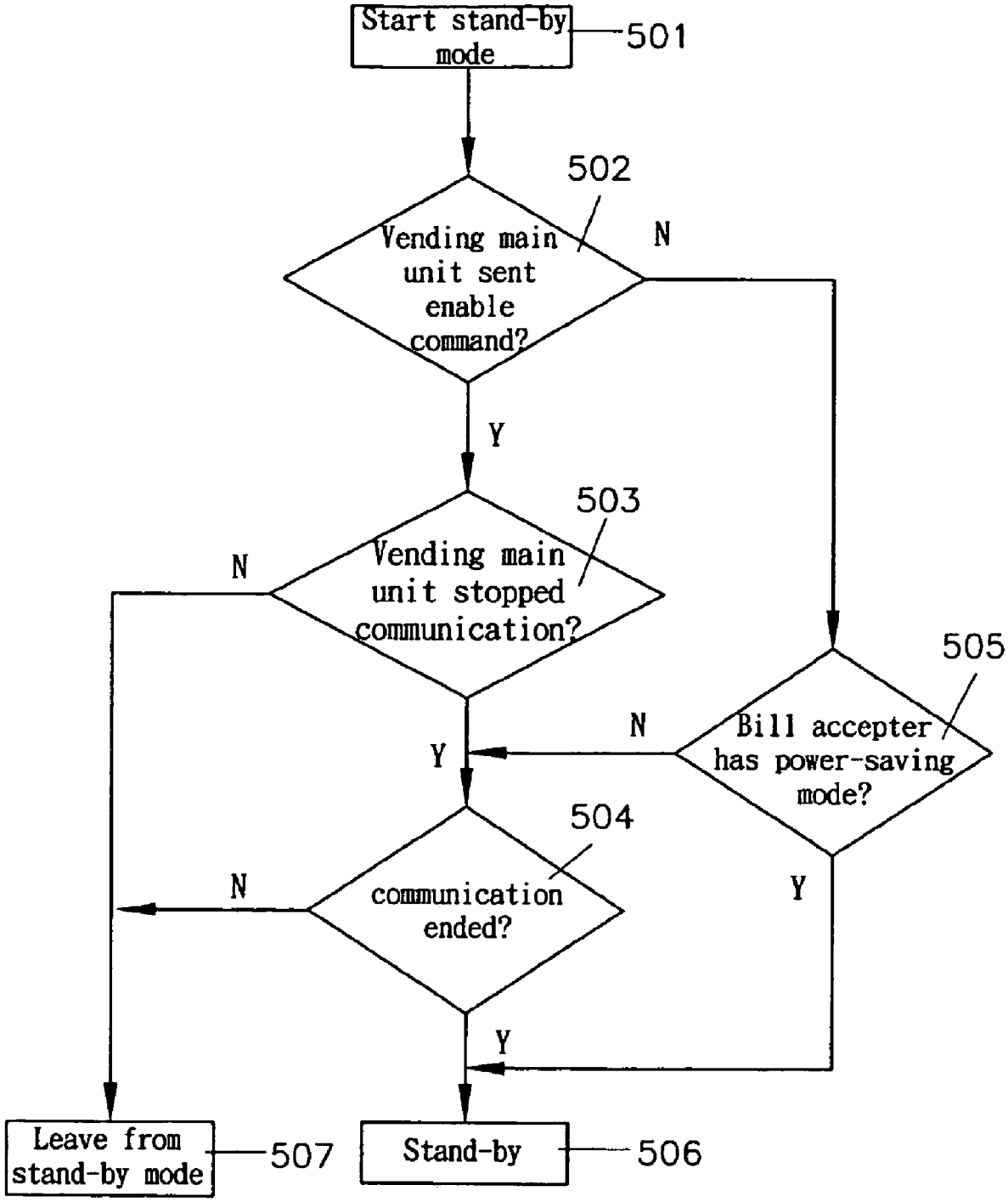
FIG. 5 is a stand-by mode operation flow chart according to the present invention.
Figure 6:
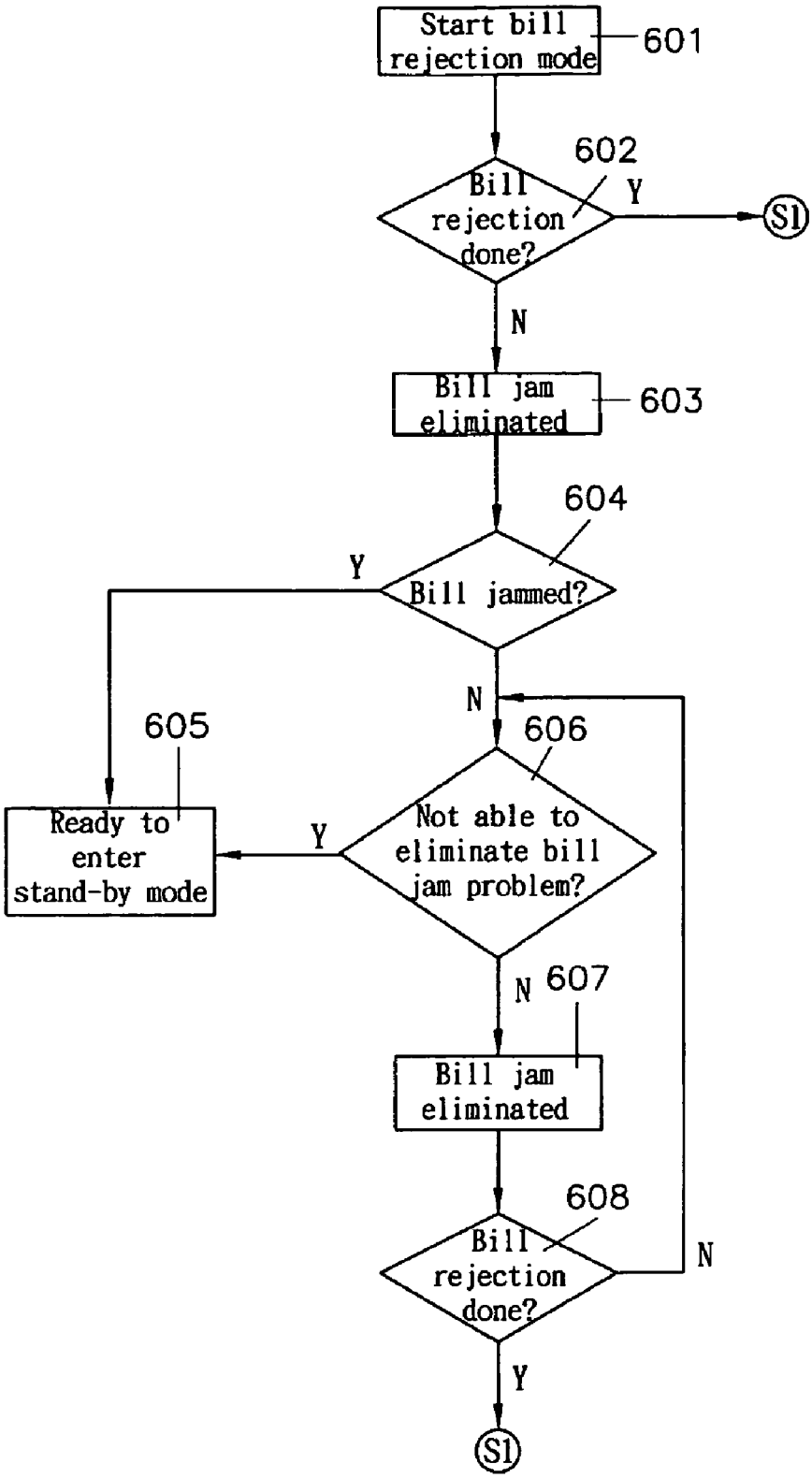
FIG. 6 is a bill rejection mode operation flow chart according to the present invention.

FIGS. 4 and 4A show the operation flows of the present invention. When the bill accepter started, it runs subject to the steps as follows:

401 Power supply turned on;
402 System initialization;
403 Determine if the system functions normal or not? And then proceed to step 404 if positive, or step 409 if negative;
404 Determine if bill accepter has been jammed or not? And then proceed to step 405 if jammed, or step 407 if not jammed;
405 Send working messaging to vending main unit, and then proceed to step 406;
406 Enter troubleshooting mode (see FIG. 6);
407 Send working messaging to vending main unit, and then proceed to step 408;
408 Enter stand-by mode (see FIG. 5);
409 Determine whether vending main unit has been connected? And then proceed to step 412 if connected, or step 410 if not connected;
410 Determine if to change stand-by mode to work mode or not? And then proceed to step 412 is positive, or step 411 if negative;
411 Be ready to enter stand-by mode, and then proceed to step 409;
412 Wait for insertion of bill, and then proceed to step 413;
413 Determine whether there is any bill to be accepted? And then proceed to step 415 if positive, or step 414 if negative;
414 Be ready to enter power-saving mode, and the proceed to step 413;
415 ccept inserted bill, and the proceed to step 416;
416 Determine whether inserted bill has been delivered into position? And then proceed to step 418 from S2 if positive, or step 417 if negative;
417 Enter bill rejection mode (see FIG. 6);
418 Determine whether vending main unit has been connected? And then proceed to step 419 if positive, or step 425 if negative;
419 Determine if vending main unit has been allowed to accept bill or not? And then proceed to step 420 if positive, or step 428 if negative;
420 Inform vending main unit of the value of bill, and then proceed to step 421;
421 Determine whether vending main unit has been informed to wait for transaction? And then proceed to step 422 if positive, or enter step 426 from S3;
422 Determine whether vending main unit has informed to accept bill or not? And then proceed to step 423 if positive, or step 428 if negative;
423 Send bill to money box, and then proceed to step 424;
424 Inform vending main unit of completion of bill acceptance procedure, and then enter step 412 from S1;
425 Determine whether waiting time is up? And then proceed to step 428 if positive, or step 418 if negative;
426 Determine whether to wait for the connection of vending main unit or not? And then enter step 421 from S4 if positive, or proceed to step 427 if negative;
427 Determine whether communication time is over? And then proceed to step 428 if over, or enter step 421 from S4 if not over;
428 Enter bill rejection mode (see FIG. 6).

FIG. 5 illustrates the flow of the stand-by mod. When the bill accepter entering the stand-by mode, it runs subject to the steps as follows:

501 Start stand-by mode;
502 Determine whether vending main unit has sent enable command or not? And then proceed to step 503 if positive, or step 505 if negative;
503 Determine whether vending main unit has stopped communication? And then proceed to step 504 if positive, or step 507 if negative;

504 Determine if communication ended? And then proceed to step 506 if communication ended, or step 507 if not;

505 Determine whether bill accepter has power-saving mode? And then proceed to step 506 if positive, or step 504 if negative;

506 Enter stand-by mode;

507 Leave from stand-by mode.

Referring to FIG. 4, which illustrates the operation flow of the present invention when the bill accepter started, and FIG. 6, which illustrates the operation flow of the bill rejection mode. When entered the bill rejection mode, it runs subject to the steps as follows:

601 Start bill rejection mode;

602 Determine if bill has been rejected or not? And then enter step 412 from S1, -or proceed to step 603;

603 Eliminate bill jam problem, and then proceed to step 604;

604 Determine whether bill is still jammed? And then proceed to step 605 if positive, or step 606 if negative;

605 Be ready to enter stand-by mode;

606 Determine if bill jam problem can be eliminated or not? And then proceed to step 605 if bill jam problem cannot be eliminated, or step 607 if bill jam problem can be eliminated;

607 Eliminate bill jam problem;

608 Determine whether bill rejection is done? And then enter step 412 from S1 if positive, or proceed to step 606 if negative.

As indicated above, when the bill accepter 20 or one vending main unit 30 generated a trigger signal, the bill accepter 20 immediately returns from the stand-by mode to the work mode. When runs idle, the power control circuit 10 cuts off power supply from the bill accepter 20, keeping the bill accepter 20 in the power-saving stand-by mode.

A prototype of power control circuit for use in a vending machine has been constructed with the features of the annexed drawings of FIGS. 1–6. The power control circuit for use in a vending machine functions smoothly to provide all of the features discussed earlier.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. An automatic power-on vending machine having a vending main unit, the automatic power-on vending machine comprising:

a bill acceptor;

a trigger, the trigger generating a triggering signal when the trigger is triggered by a bill; and a driver, to driver, after receiving the triggering signal, driving to bill accepter from a original stand-by mode to a work mode for the bill accepter to authenticate the bill;

wherein after the bill is authenticated by the bill accepter, the bill accepter then drives the vending main unit from a power-saving mode to a normal service mode.

2. The automatic power-on vending machine as claimed in claim 1, wherein the driver drives the bill accepter from the work mode back to the stand-by mode when the trigger does not generate the triggering signal within a predetermined period of time following the driving of the bill accepter from the stand-by mode to the work mode by the driver.

3. The automatic power-on vending machine as claimed in claim 1, wherein the trigger comprises:

an oscillation module generating an oscillating signal;

a light emitting diode receiving the oscillating signal and emitting a light signal accordingly; and a phototransistor corresponding to the light emitting diode and generating the triggering signal when the bill blocks the phototransistor.

4. A vending machine having a service providing unit, the vending machine comprising:

a bill accepter;

a trigger, the trigger generating a triggering signal when the trigger is triggered by a bill;

a driver, the driver, after receiving the triggering signal, driving the bill accepter from a stand-by mode to a work mode for the bill accepter to authenticate the bill; and a processing module connected to the bill accepter, the processing module comprising a memory which records a predetermined condition, the processing module activating the service providing unit for a first period of time based upon the predetermined condition and to value of the bill determined by the bill accepter.

5. The vending machine as claimed in claim 4, wherein the driver drives the bill accepter from the work mode back to the stand-by mode when the trigger does not further generate the triggering signal within a predetermined period of time following the driving of the bill accepter from the stand-by mode to the work mode by the driver.

6. The automatic power-on vending machine as claimed in claim 4, wherein the trigger comprises:

an oscillation module generating an oscillating signal;

a light emitting diode receiving the oscillating signal and emitting a light signal accordingly; and a phototransistor corresponding to the light emitting diode and generating the triggering signal when the bill blocks the phototransistor.

7. A vending machine having a service providing unit, to vending machine comprising:

a bill accepter;

a trigger, the trigger generating a triggering signal when the trigger receives an second activating signal generated from the vending machine;

a driver, the driver, after receiving the triggering signal, driving the bill accepter from an original stand-by mode to a work mode for the bill accepter to authenticate a bill; and a processing module connected to the bill accepter, the processing module comprising a memory recording a predetermined condition, the processing module activating the service providing unit for a first period of time based upon the predetermined condition and the value of the bill determined by the bill acceptor.

8. The vending machine as claimed in claim 7, wherein the driver drives the bill accepter from the work mode back to the stand-by mode when the trigger does not generate the triggering signal within a predetermined period of time following the driving of the bill accepter from the stand-by mode to the work mode by the driver.

9. The automatic power-on vending machine as claimed in claim 7, wherein the vending machine further comprises an activating device to generate the second activating signal when the activating device is active.

10. A power control circuit, for a vending machine having a bill accepter, the power control circuit comprising:

a banknote triggering module generating a first activating signal when the banknote triggering module is triggered by a bill;

a dual-mode trigger generating a triggering signal when the dual-mode trigger receives the first activating signal generated from the banknote triggering module or a second activating signal generated from the vending machine; and a driver, the driver, after receiving the triggering signal, driving the bill accepter from a stand-by mode to a work mode for the bill accepter to authenticate the bill;

wherein the second activating signal is generated from the vending machine when an activating device in the vending machine is active.

11. The power control circuit as claimed in claim 10, wherein the driver drives the bill accepter from the work mode back to the stand-by mode when the dual-mode trigger does not generate to trigger signal within a predetermined period of time following the driving of the bill accepter from the stand-by mode to the work mode by the driver.

12. The power control circuit as claimed in claim 10, wherein the banknote triggering module comprises:

an oscillation module generating an oscillating signal;

a light emitting diode receiving the oscillating signal and emitting a light signal accordingly; and a phototransistor corresponding to the light emitting diode and generating the triggering signal when the bill blocks the phototransistor.

13. The power control circuit as claimed in claim 10, wherein the bill accepter drives the vending machine from a power-saving mode to a normal service mode following the bill accepter is driven from a stand-by mode to a work mode after the dual-mode trigger receives the first activating signal generated from the banknote triggering module.

14. The power control circuit as claimed in claim 10, wherein the activating device drives the vending machine from a power-saving mode to a normal service mode after the activating device is active.

* * * * *